US006497412B1

(12) United States Patent
Bramm

(10) Patent No.: US 6,497,412 B1
(45) Date of Patent: Dec. 24, 2002

(54) METHOD AND APPARATUS FOR PLAYING A QUIZ GAME

(76) Inventor: Peter J. Bramm, 18263 Coral Isles Dr., Boca Raton, FL (US) 33498

( * ) Notice: Subject to any disclaimer, the term of this patent is extended or adjusted under 35 U.S.C. 154(b) by 12 days.

(21) Appl. No.: 09/658,521

(22) Filed: Sep. 8, 2000

(51) Int. Cl.[7] ..... A63F 1/00
(52) U.S. Cl. ..... 273/430; 273/431
(58) Field of Search ..... 273/429, 430, 273/431, 432

(56) References Cited

U.S. PATENT DOCUMENTS

| | | | | |
|---|---|---|---|---|
| 4,326,711 A | | 4/1982 | Giallombardo | 273/1 R |
| 4,690,025 A | | 9/1987 | Hines et al. | 84/1.18 |
| 4,807,878 A | | 2/1989 | Tripp | 278/1 E |
| 5,106,097 A | | 4/1992 | Levine | 273/237 |
| 5,121,928 A | | 6/1992 | Salerno-Sonneberg | 273/243 |
| 5,131,663 A | | 7/1992 | Klein | 273/256 |
| 5,157,643 A | | 10/1992 | Suzuki | 369/33 |
| 5,178,545 A | * | 1/1993 | Thompson | |
| 5,180,309 A | * | 1/1993 | Egnor | |
| 5,405,153 A | | 4/1995 | Hauck | 273/460 |
| 5,486,006 A | | 1/1996 | Bruno et al. | 273/301 |
| 5,893,561 A | | 4/1999 | Hoffman | 273/243 |
| 5,925,843 A | | 7/1999 | Miller et al. | 84/609 |
| 6,038,367 A | * | 3/2000 | Abecassis | |
| 6,267,379 B1 | * | 7/2001 | Forrest et al. | |
| 6,322,074 B1 | * | 11/2001 | Forrest et al. | |
| 6,349,942 B1 | * | 2/2002 | Solboe | |

* cited by examiner

*Primary Examiner*—William M. Pierce
(74) *Attorney, Agent, or Firm*—Daniel C. Crilly

(57) ABSTRACT

A quiz game in which a player must attempt to answer one or more questions in a selected category employs a method for selecting the category to enhance the fairness of the game over a wide range of players' ages. At least one attribute of the category is selected by chance and at least one other attribute of the category is selected based on an individual preference of the player, wherein the selected category is defined by all of the selected attributes. Basing the category selection at least in part on the individual preference of the player increases the player's chances of correctly answering the question(s). Such a category selection method may be beneficially employed in an audio quiz game (e.g., a music trivia game) that includes a source of categorized questions and answers, an audio playing device that can selectively access and play pre-stored audio clips, and one or more selectors for selecting the by-chance attribute(s) of the category. The audio quiz game preferably utilizes an audio playing device that receives the category attributes, automatically retrieves the corresponding audio clip based on the entered attributes, and plays the clip at the instruction of the player. The game may be implemented as a discrete set of game components, or electronically as a hand-held game unit or as software to facilitate play between remote computer users over a network, such as the Internet.

49 Claims, 4 Drawing Sheets

| | YEAR | MUSIC GENRE | POINTS | TOTAL |
|---|---|---|---|---|
| # 1 HITS | | | | |
| TOP 10 HITS | | | | |
| TOP 20 HITS | | | | |
| GRAMMY-FEMALE | | | | |
| GRAMMY-MALE | | | | |
| DOVE | | | | |
| ALBUM OF THE YEAR | | | | |
| TOP 10 TV SHOW THEME SONGS | | | | |
| TOP 5 MOVIE THEME SONGS | | | | |

110

METHOD AND APPARATUS FOR PLAYING A QUIZ GAME

FIELD OF THE INVENTION

The invention relates generally to quiz games and, in particular, to a method and apparatus for playing a quiz game that substantially eliminate the age-based inequities present in such games.

BACKGROUND OF THE INVENTION

Quiz games are a well-known form of family entertainment. Many such quiz games exist, and common games include: "TRIVIAL PURSUIT," "WHO WANTS TO BE A MILLIONAIRE," "JEOPARDY," and "OUTBURST." However, most quiz games, although generally intended for players in a broad age range, do not provide a so-called "level playing field" for all players due to the lack of education and experience of younger players and the failure of some older players to keep current on styles and events. In most quiz games, a category is selected completely by chance from the perspective of the player whose turn it is (e.g., through the player's roll of a die or dice, or through selection of the category by someone other than the player). For example, in "TRIVIAL PURSUIT," the question category is selected by the player's roll of a die; whereas, in "JEOPARDY" and "WHO WANTS TO BE A MILLIONAIRE," the question categories for each round are selected by a non-player (at least in the television game show). Thus, prior art quiz games do not provide a mechanism to allow the player whose turn it is to attempt to answer a question he or she has a reasonably good chance of answering correctly. Many games attempt to "level the playing field" by including a wide variety of question categories in an effort to increase the likelihood that the question category selected by chance will contain a question that the player has a reasonably good chance to answer. However, as many a player can attest, such an attempt is often not successful.

One type of prior art quiz game is an audio quiz game in which a player must answer one or more questions related to an audio clip played from an audio playing device. Such an audio quiz game is disclosed in U.S. Pat. No. 5,106,097 (the '097 patent). This quiz game uses a compact disk (CD) player to play an audio clip relating to a category of questions and answers selected completely by chance. Each track of a CD contains one or more audio clips separated by audio queues. The questions and answers relating to the CD tracks are provided in a book or on playing cards or in computer memory, and can be randomly accessed.

In accordance with the '097 patent, a player spins a spinner to select a CD track and, therefore, the category of the audio clip be played. Once the CD track has been selected, an opposing player finds the page of the book corresponding to the selected CD track and identifies the question category associated with the selected CD track. The opposing player or a dedicated CD jockey locates the CD with the selected track, inserts the CD into the CD player, and advances the CD to the selected track. The player whose turn it is then selects a difficulty level (e.g., from 1–5) for the question to be answered, and the opposing player reads a question from the question and answer book which is in the selected category and has the appropriate level of difficulty. After the question is read, the audio clip is played and the player attempts to answer the question based on the content of the audio clip. If the question is answered correctly, the player may move his or her game piece a number of spaces on the game board that is equivalent to the difficulty level of the question. For example, if the player answered a question correctly having a difficulty level of three, the player may move his or her game piece three spaces on the game board.

As evident from the foregoing, the audio quiz game disclosed in the '097 patent suffers from the same ailment as all other quiz games: the category of the question(s) to be answered is selected completely by chance, thereby creating an inequality among players of varying ages. In addition, the audio quiz game disclosed in the '097 patent requires a person (a player or a dedicated CD jockey) to locate the CD with the selected track and queue the appropriate audio clip for play, thereby causing undesirable delays in the flow of the game. The '097 patent does suggest the use of a fixed index for each audio clip and the use of indexing features of a CD player to enable a desired audio clip index to be input into a keyboard of the CD player to facilitate immediate access to the desired audio clip. However, the suggested fixed indexing approach requires the index number for a desired audio clip to be known by the person using the keyboard to enter the index number. Such a requirement necessitates another game component (e.g., a book) that correlates the indexes with the audio clips.

Therefore, a need exists for a method and apparatus for playing a quiz game, such as an audio quiz game, that provide a "level playing field" for players having a wide range of ages. Such an apparatus that further includes an audio playing device that provides automatic retrieval of an audio clip without requiring the user or players to know the exact address or index of the clip would be a further improvement over prior art audio quiz games.

DETAILED DESCRIPTION OF A PREFERRED EMBODIMENT

Generally, the present invention encompasses a method and apparatus for playing a quiz game in which a player must attempt to answer one or more questions in a selected category. In accordance with the present invention, the category for the question(s) is chosen by selecting at least one attribute (e.g., a decade) of the category by chance and selecting at least one other attribute (e.g., a type or genre of music) of the category based on an individual preference of the player. By basing the category selection at least in part on the individual preference of the player, the player has a greater likelihood of answering the question(s) correctly due to the player's familiarity with his or her preferences, as compared to when the question category is chosen only by chance as in the prior art. Including the individual preference of the player in the category-selection process serves to "level the playing field" and facilitate fair competitive play across a wide range of ages. Such a category selection method may be beneficially employed in an audio quiz game (e.g., a music trivia game) that includes a source of categorized questions and answers, an audio playing device that can selectively access and play prestored audio clips, and one or more selectors for selecting the by-chance attribute(s) of the category that relates to the audio clip to be played and from which the question(s) must be answered.

Figure 1:
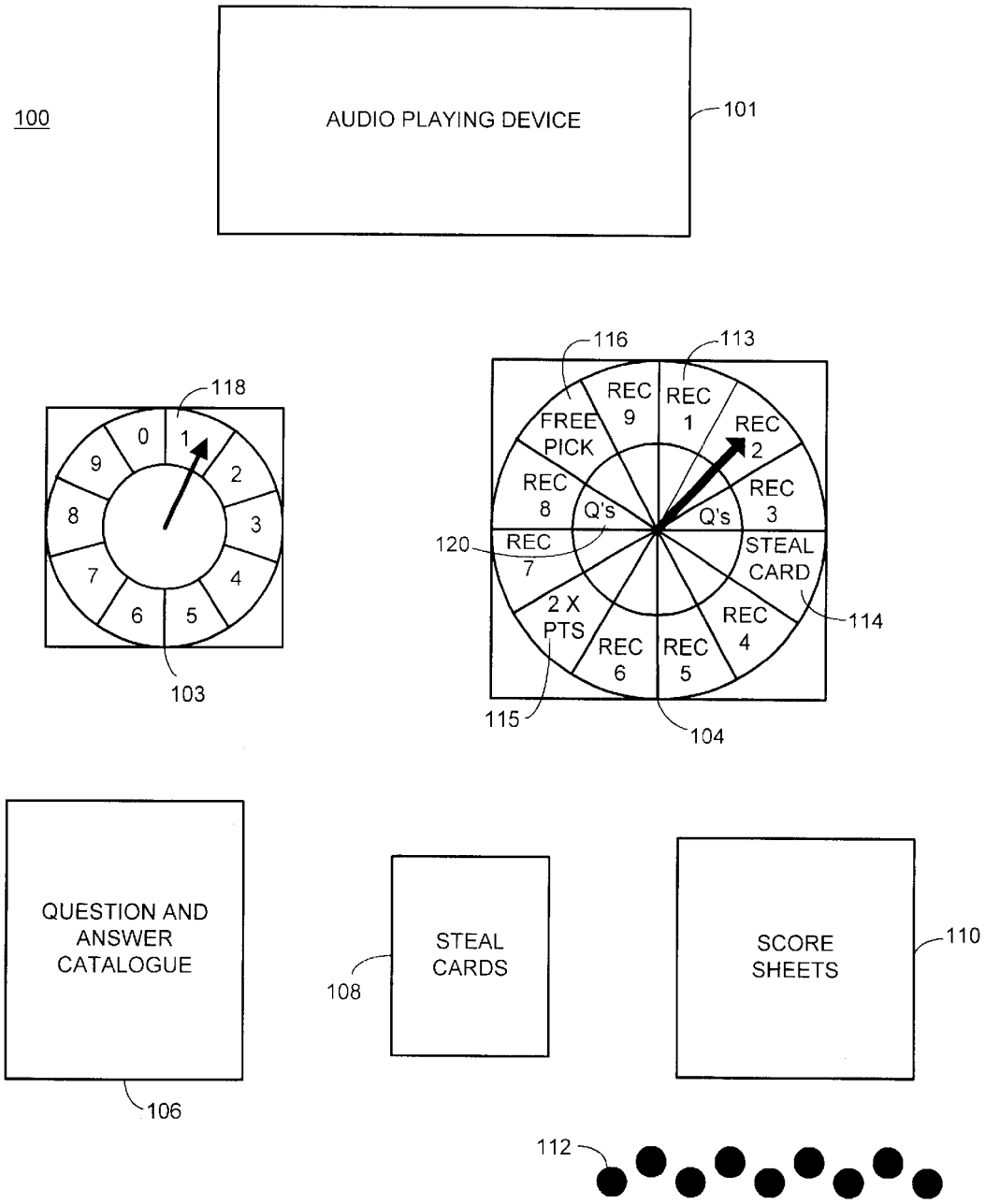
FIG. 1 is a block diagram of an audio quiz game in accordance with a particular embodiment of the present invention.

The present invention can be more fully understood with reference to FIGS. 1–5, in which like reference numerals designate like items. FIG. 1 is a block diagram of an audio quiz game 100 in accordance with a particular embodiment of the present invention. The audio quiz game 100 includes an audio playing device 101, a plurality of by-chance attribute selectors, and a question and answer catalogue 106. The audio quiz game 100 might optionally further include so-called "STEAL" cards 108 or some other indicia to enable one player to indicate a desire to acquire the points or other benefits of another player as described in detail below, score sheets 110, and game tokens 112.

The audio playing device 101 accesses and retrieves one of multiple pre-stored audio clips responsive to receiving inputs identifying a group of attributes that define the category of questions and answers with which the audio clip is associated. The audio playing device 101 also plays the retrieved audio clip responsive to receiving an input indicating a user's or a player's desire to hear the retrieved clip. A preferred audio playing device 101 is described in detail below with respect to FIGS. 2–4.

The by-chance attribute selectors are preferably implemented as two spinners 103, 104, but may be alternatively implemented in any other manner (e.g., as dice, as a single multi-faceted spinning device such as described in U.S. Pat. No. 4,326,711, as decks of cards, or as bounded random number generators in the event that the quiz game described herein is implemented in a fully electronic form (e.g., as a hand-held game or as a game playable on a single computer or over a network, such as the Internet)). When the audio quiz game is a music quiz game, the spinners 103, 104 might physically resemble record albums, such as 33 ⅓-RPM and 45-RPM speed record albums, to match the motif of the game.

The question and answer catalogue 106 is a source of questions and answers corresponding to categories defined by attributes selected partially by chance and partially by the preference of each player within the context of the game 100. The question and answer catalogue 106 is preferably implemented as a booklet, but may be in any form. In a fully electronic version of the game, the question and answer catalogue 106 might be implemented as a database stored in a memory of the electronic game from which a processing device, such as a microprocessor, could retrieve the questions in response to entered category attributes.

The "STEAL" cards 108 are playing cards that include an appropriate label on one side (e.g., "STEAL CARD") and instructions for how to use the card on the other side. The function of the "STEAL" cards 108 is to indicate a desire by one player to acquire or "steal" the points or other benefits generally entitled to another player. Accordingly, as noted above, the function of the "STEAL" cards 108 may be implemented using any other indicia, such as a token or a chip, to enable one player to indicate a desire to acquire the points or other benefits (e.g., game token 112) of another player.

Figures 3, 5:
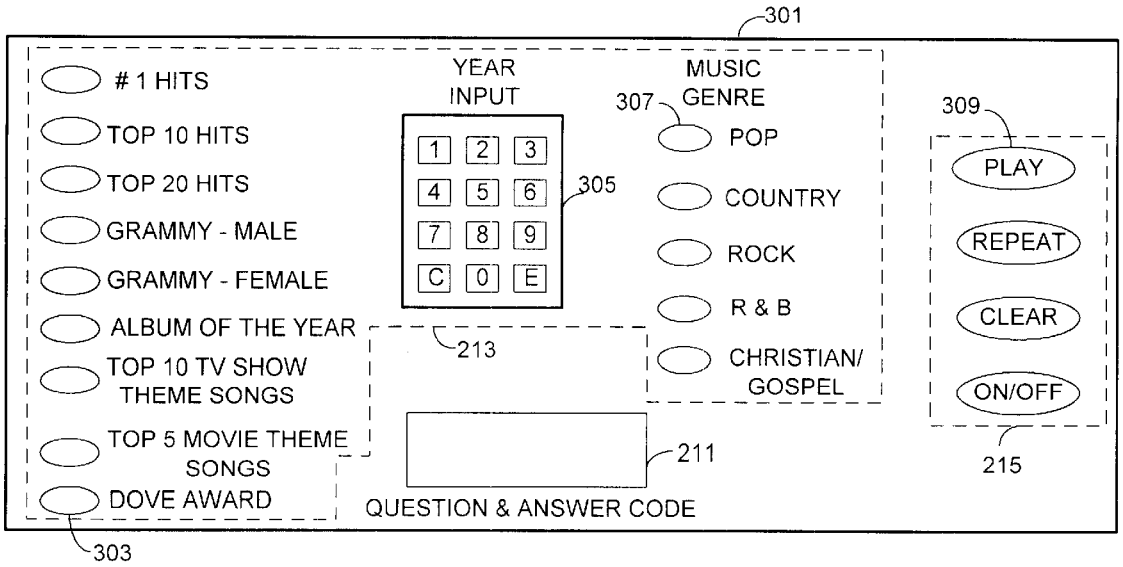
FIG. 3 is a front elevational view of an exemplary front panel of the audio playing device of FIG. 2 in accordance with the present invention.
FIG. 5 is an exemplary preprinted score sheet for use in playing the audio quiz game of FIG. 1.

The score sheets 110 may be blank or may be preprinted with the identifications of the attributes that define the question and answer categories. An exemplary preprinted score sheet 110 for use in playing a music quiz game is depicted in FIG. 5. The game tokens 112 are unique tokens that identify a particular key attribute of different question and answer categories. The uniqueness of each token 112 may be implemented in any manner so long as each token identifies a different key category attribute. In a preferred embodiment, the tokens 112 have shapes that relate to a predetermined set of recognition attributes that are selected by chance by the player. For example, one token 112 might be in the shape of a trophy to identify a category that has a recognition attribute of an award, such as a "GRAMMY" award or a "DOVE" award; whereas, another token 112 might be in the shape of a record album to identify a category that has a recognition attribute of acquiring a certain status, such as the number one hit of the year as selected by "BILLBOARD" magazine. Tokens 112 with similar shapes may be differentiated by color or by any other means (e.g., size, thickness, and so forth).

The quiz game 100 is played as follows in accordance with a preferred embodiment of the present invention. The player whose turn it is (hereinafter referred to as the "active player") selects the category for the questions to be answered by first spinning spinner 104 to select a first category attribute by chance. In the preferred embodiment, the first category attribute is an attribute related to the recognition received by a song or its artist. Examples of such recognition attributes include, but are not limited to, "Number One Hit" as compiled by "BILLBOARD" magazine, male "GRAMMY" award winner, female "GRAMMY" award winner, "DOVE" award winner, "Top 10 Hits" as complied by "BILLBOARD" magazine, "Top 20 Hits" as compiled by "BILLBOARD" magazine, "Album of the Year" as compiled by "BILLBOARD" magazine, "Top 10 TV Show Theme Songs" as compiled by the A.C. Nielsen Company, and the movie theme songs associated with the top five movies as determined by box office sales ("Top 5 Movie Theme Songs"). Spinner 104 is divided into several sections 113–116, some 112 of which identify a recognition attribute (e.g., sections 113 identified as "REC 1" through "REC 9" on spinner 104) and others 114–116 of which may optionally instruct the active player to perform some other task (e.g., take a "STEAL" card as indicated by section 114), give the player the option of selecting one of the listed recognition attributes based on the player's individual preference (e.g., make a "FREE PICK" as indicated by section 115), or indicate that the player will receive double points (e.g., as indicated by the "2X PTS" label of section 114). The active player spins spinner 104 until a recognition attribute is selected by chance or until the spinner needle lands on the "FREE PICK" section, thereby enabling the player to select the recognition attribute by preference.

After the active player has selected at least one category attribute (e.g., a recognition attribute) by chance, the active player selects at least one other category attribute based on the player's individual preference. In the preferred embodiment, the active player selects a time attribute by preference, such as a decade in which the player is most familiar with the music released during that time period. Other attributes may optionally be selected by chance or by preference as desired to ultimately arrive at a set of attributes that define the category for the question or questions to be answered. In the preferred embodiment, after selecting the recognition attribute by chance and a time attribute by preference, the active player selects another time attribute by chance by spinning the needle of spinner 103 to select a time period (e.g., the year) within the previously selected time period (e.g., decade). As shown, spinner 103 is divided into ten sections 118 labeled "0" through "9" corresponding to the ones digit for each year of a decade. Lastly, the active player selects a final category attribute, such as a type or genre of music, by preference to complete the selection of attributes that define the question and answer category.

For example, the active player's selection of category attributes may occur as follows. The active player spins spinner 104 and the spinner needle lands on "Top 10 Hits." Thus, the recognition attribute is "Top 10 Hits." Next, the player elects to be quizzed on the decade of the 1980's and spins spinner 103 such that the spinner needle lands on the section 118 labeled "1". Thus, the resulting year attribute is "1981." Finally, the player elects to be quizzed on "Rock" music. Therefore, the selected category is "Top 10 Rock Hits from 1981."

One of ordinary skill in the art will appreciate that the order set forth above of selecting category attributes partially by chance and partially by player preference is exemplary only and any order may be used provided that at least one category attribute is selected based on the preference of the active player. For example, the active player may first select the decade and music type by preference and then spin the spinners 103, 104 to select the year of the decade and the recognition attribute by chance.

The active player or another player enters the selected attributes (e.g., "Top 10 Hits," "1981," and "Rock") into the audio playing device 101 via predetermined buttons and/or a keypad as described in more detail below and the audio playing device 101 automatically retrieves the music clip associated with the selected category from a digital storage medium, such as embedded flash memory, a flash memory card or a CD. The active player (or the "stealing player" as described in detail below) then instructs the audio playing device 101 (e.g., by depressing a "PLAY" button on the device 101) to play the retrieved music clip. In a preferred embodiment, the music clip is fifteen seconds long, but any length clip may be used.

After the music clip finishes or at some other time (e.g., while the music clip is playing), another player looks up the questions for the selected category in the question and answer catalogue 106. The question and answer catalogue may be indexed and divided into sections based on potential category attributes (e.g., the first section of the catalogue 106 may include all the possible questions and answers for "Rock" music, the second section for "Blues" music, and so on). Each section may further be divided into subsections corresponding to the other attributes. For example, the first page of the first section of the catalogue 106 may include questions and answers relating to number one Blues hits from 1940–1949.

Alternatively, and more preferably, the audio playing device 101 displays a code, either audibly or in an alphanumeric form on a visual display, that corresponds to a matching location in the catalogue 106 at which the questions and answers for the selected category are provided. For example, the audio playing device might display a code such as "81-3-R" to identify the audio clip as being the third most popular Rock-music hit from 1981, which would be in the "Top 10 Rock Hits of 1981" category as selected above. In such a case, the player who will ask the question or questions in the category need only find the matching code in the question and answer catalogue 106 to locate the question(s).

Still further, the questions (Q's) may be written on spinner 104 in allocated sections or areas 120, and only the answers to the questions may be in the catalogue 106. For example, every category having a recognition attribute of "Male GRAMMY Award Winner" would require the player to answer the same two questions (e.g., "What is the name of the winner?" and "What is the title of the song?") that are preprinted on spinner 104 in an area 120 of the spinner 104 adjacent the identity of the attribute (e.g., in the pie segment between the identity of the recognition attribute and the center of the spinner 104).

After listening to the question(s) in the category, the active player (or the stealing player as described in detail below) attempts to answer each asked question. Each question has a predetermined number of points associated with it. The answering player receives the points associated with each question correctly answered and writes the points on his or her score sheet 110. If the player answers all the questions in the category correctly, the player receives the points associated with each correctly answered question and a game token 112 corresponding to an attribute (e.g., an attribute selected by chance, such as the recognition attribute) of the category. For example, if the player answers all of the questions correctly in the "Top 10 Blues Hits of 1984" category, the player might receive twenty points (ten points for each of two questions) and a game token 112 in the shape of a record album with the number ten in the center to indicate "Top 10." If the player does not answer any questions correctly, the player receives no points (and may lose points in the case of a stealing player as described below). Before attempting to answer the questions, the player may replay the music clip or segment once (e.g., by depressing a "REPEAT" or "REPLAY" button on the audio playing device 101) to aid in his or her attempt to answer the questions. After the answering player gives his or her answers to the questions, another player compares the given answers to the answers in the question and answer catalogue 106.

During the active player's turn, another player (referred to as the "stealing player") may indicate his or her intention to attempt to answer the questions in the selected category before the active player has an opportunity to answer such questions. The stealing player makes his or her intention known by placing a "STEAL" card 108 on the playing surface or presenting some other equivalent indicia to all the players. The "STEAL" card 108 may be played at any time before the active player attempts to answer the category questions (even before the category attributes are selected), but would normally be played after the category has been selected and the music clip has been layed. A "STEAL" card 108 is obtained by chance during a player's active turn by spinning spinner 104 and having the spinner needle land on the section 114 labeled "STEAL CARD" or an equivalent.

After, playing the "STEAL" card 108, the stealing player has the opportunity to answer the questions in the category selected by the active player and, thereby, "steal" the points and/or game token 112 from the active player. If the stealing player answers all the questions in the selected category correctly, the stealing player receives the points associated with each correctly answered question and a game token 112 corresponding to an attribute of the category. If the stealing player answers some, but not all, of the questions in the category correctly, the stealing player receives the points associated with the correctly answered questions and the active player then gets the opportunity to answer the remaining questions and receive the points associated with those questions. If the stealing player does not correctly answer at least one question in the selected category, the stealing player is penalized. For example, the stealing player may be required to subtract the aggregate number of points associated with all the questions in the selected category from the stealing player's current point total or return a game token 112, at the option of the stealing player. In addition, the stealing player may be required to give his or her "STEAL" card 108 to the active player instead of returning it to the deck of "STEAL" cards 108.

After the active player completes his or her turn, play proceeds to the next player for selection of a new category. To reduce the likelihood that a particular audio clip will be replayed during a subsequent turn of any player, the audio playing device 101 preferably keeps track of the previously played audio clips and prohibits a previously played audio clip from being replayed, except in response to an express instruction to replay a clip as described above (e.g., via depression of the "REPEAT" or "REPLAY" button). Alternatively, the answering player may note the attributes of the selected category and, if necessary, the identity of the audio clip relating to the category (e.g., where a particular category, such as "Top 10 Blues Hits of 1984," relates to more than one audio clip) on his or her score sheet 110 and inform another player that an audio clip has already been played if the other player's category attribute selections result in the same audio clip being played. In either case, if the selected category will result in a prior audio clip being played, the player must re-select the category by re-selecting one of the by-chance attributes (e.g., by re-spinning spinner 103 or spinner 104).

In yet another embodiment, the player may be allowed to hear a previously played audio clip if the player is not the same player whose turn it was when the audio clip was played previously. Such an embodiment would serve to determine how closely the player was paying attention when the audio clip was first played. Play continues until one player reaches a point threshold (e.g., 100 points) or accumulates a threshold number of game tokens 112 (e.g., four game tokens 112).

Figure 2:
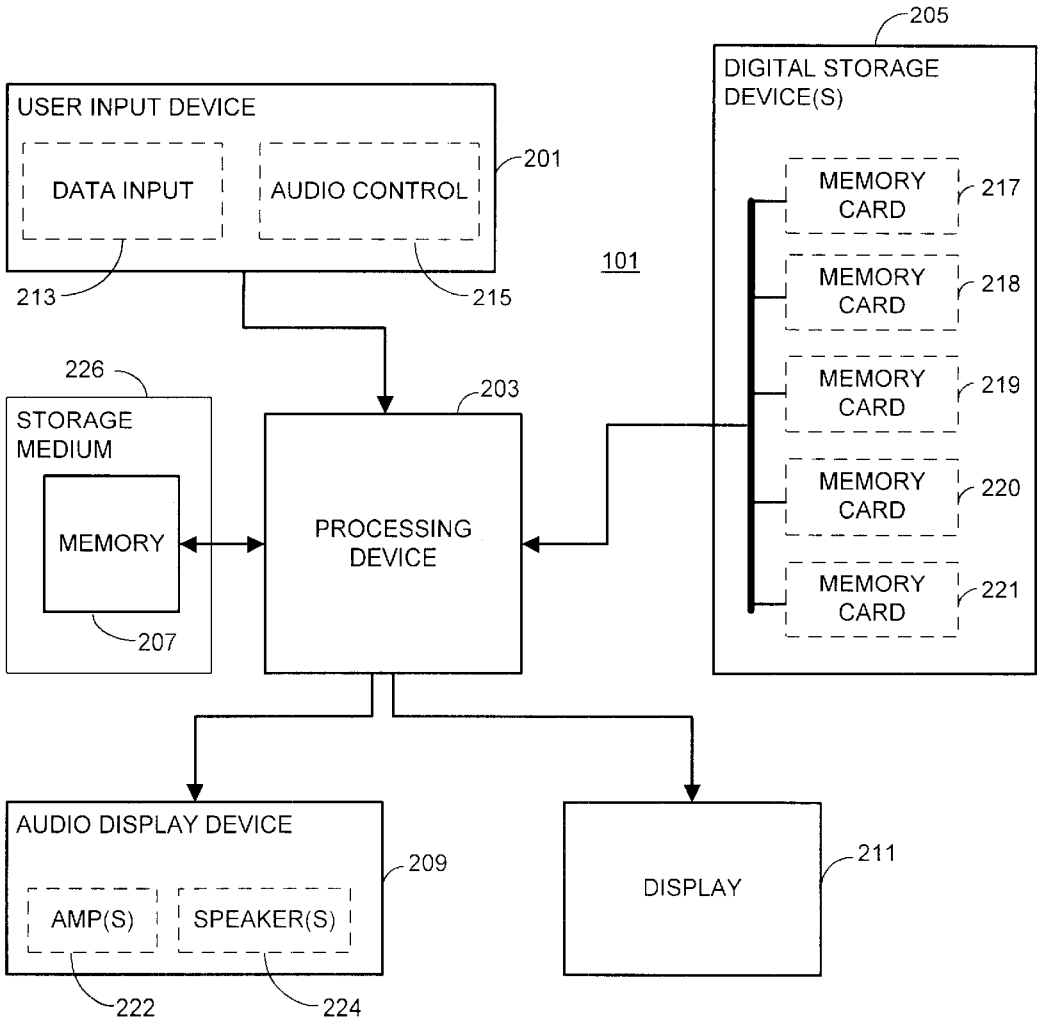
FIG. 2 is an electrical block diagram of an audio playing device for use in playing the audio quiz game of FIG. 1 or as a stand-alone device.

A preferred embodiment of the audio playing device 101 will now be described with reference to FIGS. 2–4. FIG. 2 is an electrical block diagram of the preferred audio playing device 101. The audio playing device 101 includes a user input device 201, a processing device 203, one or more digital storage devices 205, memory 207, an audio display device 209, and a display 211. The user input device 201 preferably includes a data input portion 213 and an audio control portion 215. The data input portion 213 facilitates input of the attributes defining the category of the audio clip to be played and the audio control portion 215 enables the player or user of the audio playing device 101 to listen to the audio clip. Exemplary embodiments of the data input and audio portions 213, 215 of the user input device 201 are illustrated in FIG. 3 in the form of an exemplary front panel 301 for the audio playing device 101.

As illustrated in FIG. 3, the data input portion 213 of the user input device 201 might include a first group of buttons 303 for inputting a category recognition attribute, a keypad 305 for entering the category year attribute, and a second group of buttons 307 for inputting the music type or genre attribute. The audio control portion 215 of the user input device 201 might include another group of buttons 309 that enable the player or user to instruct the audio playing device 101 to play an audio clip, repeat or replay a previously played audio clip, clear the audio clip selection, and turn the audio playing device 101 on and off. The audio control portion 215 might further include a control (not shown) for varying the volume of the played audio.

The processing device 203 includes one or more processors. Each processor may be a microprocessor, a microcontroller, a digital signal processor (DSP), a state machine, logic circuitry, or any other device that processes information based on operational or programming instructions. One such microprocessor that is designed particularly for decompressing compressed digital audio is the model EP7212 embedded processor that is commercially available from Cirrus Logic, Inc. of Austin, Tex. One of ordinary skill in the art will recognize that when the processing device 203 has one or more of its functions performed by a state machine or logic circuitry, the memory containing the corresponding operational instructions may be embedded within the state machine or logic circuitry.

The digital storage device(s) 207 contain music clips in compressed MP3 format and are preferably implemented as flash memory cards 217–221 and/or embedded flash memory. For example, one memory card 217 may include all the rhythm and blues "R & B" music clips and another memory card 218 may include all the "Country" music clips. Flash memory cards 217–221 for storing MP3 music files are commercially available from SanDisk Corporation of Sunnyvale, Calif. The memory cards 217–221 are preferably inserted into appropriate slots in the playing device 101, such that the cards 217–221 interconnect with a bus or other communication link facilitating access to the cards 217–221 by the processing device 203.

Alternatively, music clips corresponding to a predetermined set of music types (e.g., Country, Rock, Pop, Blues, Gospel, Big Band, Television Themes, and Movie Themes) may be stored in embedded flash memory integrated circuits (e.g., within memory 207), and flash memory cards 217–221 may be used to expand the music types that may be listened to or used to play the game 100. Flash memory integrated circuits are commercially available from various manufacturers, including Intel Corporation, Advanced Micro Devices, Inc., and Atmel Corporation. The digital storage device(s) 207 may further or alternatively include other digital storage media, such as floppy disks, CDROMs, digital versatile disks (DVDs), magnetic tapes or any other medium for storing digital information.

The memory 207 preferably includes various forms of memory, including read only memory (ROM), random access memory (RAM), or any other medium for storing digital information. The memory 207 may reside in an internal storage medium, such as one or more integrated circuits (ICs) imbedded in the playing device 101, or may reside in an external storage medium 226, such as a memory card, a floppy disk, a CD-ROM, a DVD, a magnetic tape or any other medium for storing digital information. The memory 207 preferably includes at least one database relating the audio category defined by the category attributes to the audio clip and relating the audio clips with their corresponding addresses within the digital storage device(s) 205. The memory 207 also preferably includes the operating instructions for the processing device 203. Accordingly, the operating instructions for the processing device 203 may be implemented in firmware (e.g., when the operating instruction storage portion of the memory 207 is embedded within the playing device 101) or in software (e.g., when the operating instruction storage portion of the memory 207 resides in an external storage medium 226).

The audio display device 209 preferably includes one or more audio amplifiers 222 and one or more speakers 224 for audibly playing audio signals received from the processing device 203. The audio display device 209 may also include other known components, such as one or more filters, one or more digital-to-analog (D/A) converters and a pulse code modulator, depending on the selected architecture and/or functionality of the processing device 203. For example, if the processing device 203 does not convert the compressed digital music clip stored in the digital storage device 205 into an analog signal, the audio display device 209 would at least include a D/A converter.

The display 211 is preferably an alpha-numeric display that enables the user of the playing device 101 to read a code presented on the display 211 by the processing device 203. The display 211 may be rectangular in shape as depicted in the device front panel 301 of FIG. 3, or may be any other shape. In an alternative embodiment, the display 211 may be eliminated and the codes may be presented audibly (e.g., through the use of a voice synthesizer in or operably coupled to the processing device 203) via the audio display device 209.

The audio playing device 101 operates substantially as follows in accordance with the present invention. At the time the device 101 is turned on, the processing device operating instructions instruct the processing device 203 to preferably access the digital storage device ports to detect the presence of the digital storage devices 205 (e.g., flash memory cards 217–221). Upon detecting the presence of the storage devices 205, the processing device 203 reads the directories of the devices 205 and stores the directories in a database in memory 207. Each storage device directory indicates the contents of the device 205 and the addresses for each audio clip within the device 205. In a preferred embodiment, the storage device directories are organized based on recognition attributes for a given year and each storage device 205 includes audio clips for a particular type of music. For example, the directory for each memory card 217–221 preferably contains a code identifying the type or genre of music contained on the card 217–221, year main directories and recognition attribute subdirectories. Each audio clip has a corresponding address that may be read by the processing device 203 from the directories of the memory card 217–221.

Alternatively, the database of music clip addresses may have been stored in memory 207 at the time the audio playing device 101 was manufactured under the presumption that only a predetermined set of storage devices 205 would be used to play the game 100. In such a case, the processing device 203, at start-up. would only need to scan the storage device ports or slots (when the storage devices 205 are independent of the audio playing device 101 itself) to correlate the port with the storage device, and store the correlations in memory 207. Such scanning facilitates the use of any storage device 205 in any port or slot. Still further, if the storage devices 205 form an integral part of the audio playing device 101, only the addresses of the music clips need be stored in a database in the memory 207.

The memory 207 also includes a database relating music clips or category attributes to question and answer codes. The codes are preferably used to look-up the questions to be asked of the answering player in the question and answer catalogue 106.

After the audio playing device 101 has been turned on and the processing device 203 has booted up and performed its initial device storage port scanning and other processing as described above, the player controlling the audio playing device 101 (e.g., the active player) uses the data input portion 213 of the user input device 201 to input the category attributes. For example, if the category attributes are "Top 5 Movie Theme Songs" (which was selected by chance) and "1995" (which was selected partially by player preference and partially by chance), the player preferably depresses the button 303 corresponding to the "Top 5 Movie Theme Songs" and enters "1995" into the keypad 305 (i.e., sequentially depresses the "1," "9," "9" and "5" keys, and then depresses the "E" or "Enter" key). Alternatively, if the category attributes are "Album of the Year," "1957" and "Rock," the player preferably depresses the button 303 corresponding to the "Album of the Year," enters "1957" into the keypad 305, and depresses the button 307 corresponding to the "Rock" music type. If a mistake is made while entering the year attribute, the player may depress the "C" or "Clear" key on the keypad 305 to clear the mistaken entry and re-enter the proper year.

In an alternative embodiment, the data input portion 213 might include a single button 303 for initiating category recognition attribute entry, another button 307 for initiating music type or genre attribute entry, a keypad 305, scroll buttons (not shown) and the display 211. In such an alternative embodiment, the player or user of the audio playing device 201 depresses the category recognition attribute button 303 to initiate entry of the category recognition attribute. The processing device 203 retrieves a stored list of category recognition attributes from memory 207 in response to detecting that the category recognition attribute button 303 has been depressed, and displays the list in a scrollable manner on the display 211. The player then uses the scroll buttons to select the appropriate category recognition attribute and depresses the "E" or "Enter" key on the keypad 305 to execute the selection. In a similar manner, the player or user of the audio playing device 201 depresses the music type attribute button 307 to initiate entry of the music type attribute. The processing device 203 retrieves a stored list of music types from memory 207 in response to detecting that the music type attribute button 307 has been depressed, and displays the list in a scrollable manner on the display 211. The player then uses the scroll buttons to select the appropriate music type and depresses the "E" or "Enter" key on the keypad 305 to execute the selection. In this embodiment, the display 211 might also be used to display the year attribute during and after the year attribute is entered via the keypad 305. If a mistake is made while entering any attribute, the player may depress the "C" or "Clear" key on the keypad 305 to clear the mistaken entry, and re-enter the attribute.

After using the data input portion 213 to input the category attributes, the player uses the audio control portion 215 of the user input device 201 to indicate his or her desire to listen to an audio clip in the category defined by the entered attributes. For example, after entering the category attributes, the player preferably depresses the "Play" button 309 to instruct the device 101 to play the audio clip.

The user input device 201 provides the entered category attributes to the processing device 203 in accordance with known data entry techniques. The processing device 203, upon receiving the category attributes, searches one or more of the databases in memory 207 to determine the address of the movie clip associated with the category defined by the entered attributes. In the event that an attribute, such as a recognition attribute, is received which does not have a single music clip associated with it, the processing device 203 randomly selects a music clip that meets all the requirements of the entered attributes. For example, if the entered attributes define the question and answer category as "Top 10 Pop Hits of 1987," the processing device 203 randomly selects the address of a music clip corresponding to one of the top ten "Pop" hits of the year 1987.

After determining the address of the music clip, the processing device 203 retrieves the music clip at the determined address and stores the clip in memory 207 until the processing device 203 receives a signal from the audio control portion 215 of the user input device 201 indicating the user's or player's desire to listen to the clip. While awaiting such a signal from the user input device 201, the processing device 203 may perform other processing, such as decompressing the compressed digital music clip and converting the decompressed digital audio clip into an analog signal to be provided to the audio display device 209. Once the processing device 203 receives the "Play" signal from the user input device 201, the processing device 203 provides the music clip, preferably in analog format, to the audio display device 209. The audio display device 209 amplifies and audibly plays the clip in accordance with known techniques. In addition, to reduce the likelihood that a particular audio clip will be replayed during a subsequent turn of any player, the processing device 203 preferably keeps track of the previously played audio clips (e.g., by storing an identification of each played audio clip in memory 207 and comparing an identification of an audio clip to be played with the identifications of all the previously played audio clips) and prohibits a previously played audio clip from being replayed, except in response to an express instruction to replay an audio clip as described above (e.g., via depression of the "REPEAT" or "REPLAY" button). If an audio clip has already been played, the processing device 207 preferably informs the players by displaying a message on the display device 209 instructing the active player to re-select one of the by-chance attributes (e.g., re-spin a spinner 103, 104) and re-enter the attributes using the user input device 201.

In addition to providing the music clip to the audio display device 209, the processing device 203 reads the question and answer code from memory 207 corresponding to the music clip communicated to the audio display device 209, and provides the code to the display 211 for presentment to the player or individual who will read the question(s) related to the played clip to the answering player. The processing device 203 preferably retains the played music clip in memory 207 in the event that the answering player desires to replay the clip once more before attempting to answer the question(s). If the player would like the clip repeated, the processing device 203 receives a "replay" signal from the user input device 201 and provides the music clip to the audio display device 209 again. In the preferred embodiment, the processing device 203 automatically deletes the music clip from memory 207 after replaying the clip. That is, the processing device 203 instructions preferably instruct the processing device 203 to delete the music clip after replaying the clip since the preferred game only permits a clip to be replayed once. Alternatively, the music clip may be retained in memory 207 until the processing device 203 receives a "Clear" signal instructing the processing device 203 to delete the temporarily stored music clip.

Although the audio playing device 101 was described above with respect to its operation within the context of the audio quiz game 100 of FIG. 1, the audio playing device 101 can also operate as a stand-alone device. That is, the audio playing device 101 may be used separately from the audio quiz game 100 to listen to stored music. For example, with flash memory cards being developed which can store large quantities of compressed digital music files (e.g., in MP3 format), a user could simply enter the attributes of a song (e.g., the year the song was released or popular, the type of music, and a recognition attribute of the song (e.g., #1 HIT)) and depress the "Play" button to hear the song without ever knowing the name of the song or the CD or tape the song was released on. For example, the user input device 201 may include an additional button (not shown) to indicate the user's desire to listen to music as opposed to play the game. Upon receiving such an input from the user, the processing device 203 might then retrieve and play the entire song as described above. The selection of the "Listen" button (not shown) or an equivalent button could serve to instruct the processing device 203 to retrieve the entire song instead of only a song segment, as would be retrieved when the audio playing device 101 was operating in game mode.

Figure 4:
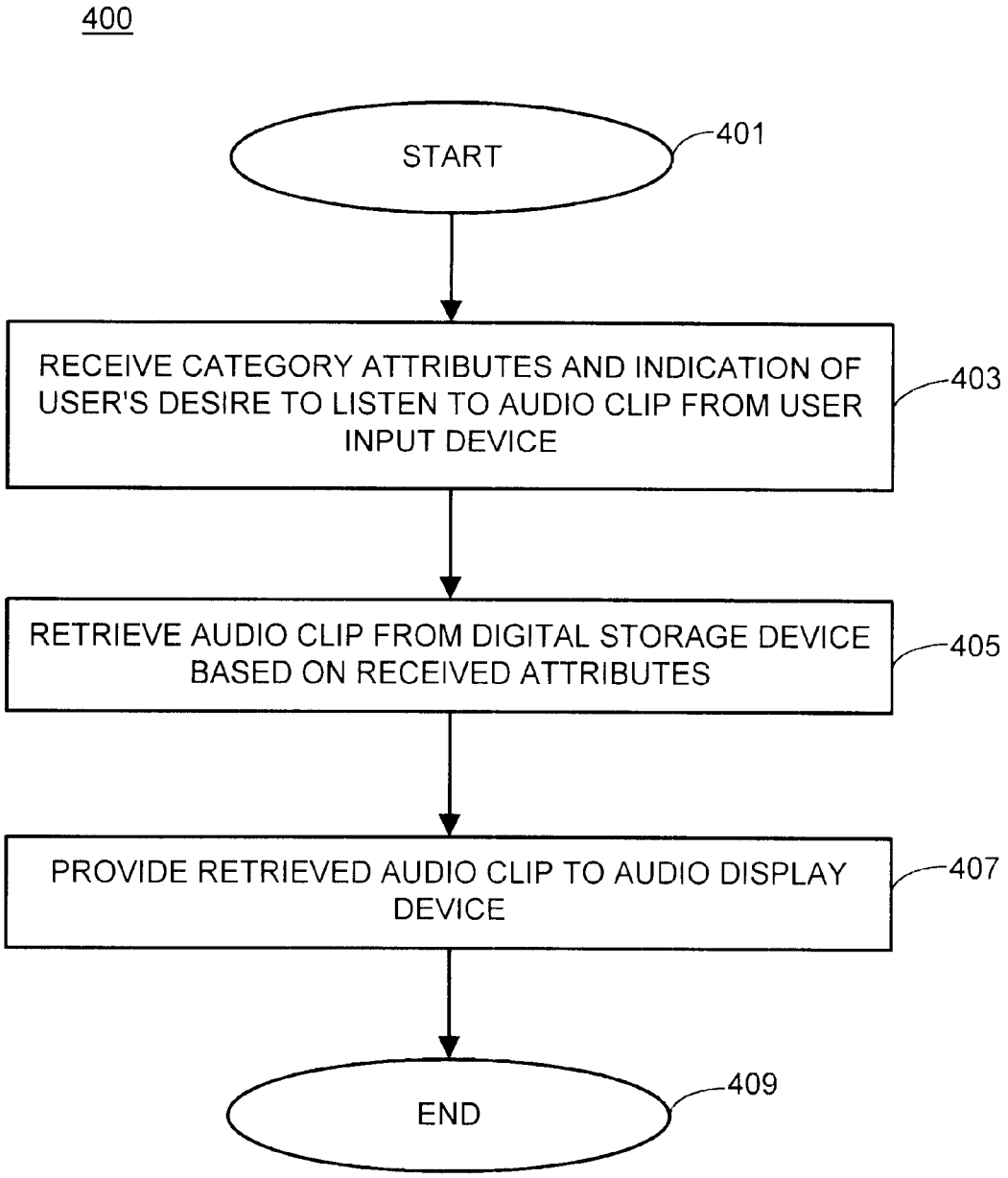
FIG. 4 is a logic flow diagram of steps executed by a processing device to instruct an audio display device to play an audio clip from a selected audio category in accordance with a preferred embodiment of the present invention.

FIG. 4 is a logic flow diagram 400 of steps executed by a processing device 203 to instruct an audio display device 209 to play an audio clip from a selected audio category in accordance with a preferred embodiment of the present invention. The logic flow begins (401) when the processing device 203 receives (403) category attributes and an indication of a user's desire to listen to the audio clip from the user input device 201. The processing device 203 then retrieves (405) an audio clip corresponding to the received attributes from a digital storage device 205 operably coupled to the processing device 203. Finally, the processing device 203 provides (407) the retrieved audio clip to the audio display device 209 for presentment of the audio clip to the user, and the logic flow ends (409). As discussed above, depending on the selected architectures of the processing device 203 and the audio display device 209, the processing device 203 might perform certain processing of the retrieve clip, such as decompression and digital-to-analog conversion, prior to communicating the retrieved audio clip to the audio displaying device 209.

Although described above with respect to its application in an audio quiz game, the partially by-chance and partially by-preference category selection technique may be applied in any game having a question and answer format. That is, the novel question and answer category selection technique described herein is not restricted to use in audio quiz games, but rather has general application to help "level the playing field" in any quiz game.

In addition, the audio quiz game 100 described herein may be implemented in a purely electronic form in which the selectors 103, 104 are random number generators activated at appropriate times responsive to a software program and in which the software prompts the user to enter category attributes to be selected based on the user's preference. In this case, the user may instruct the game unit to randomly select certain category attributes by depressing an appropriately labeled function key or touch key on a keypad or touch screen, or by using some other user input device, such as a voice recognition device, a computer mouse or a touchpad.

In the purely electronic form, all of the game components 101–112 would reside within the game unit as software or firmware modules, and game play would be controlled through the operation of software stored within the game unit (e.g., in ROM), on a storage medium readable by the game unit (e.g., a CD-ROM, a flash memory card, a floppy disk, a hard drive disk, a DVD, or any other form of digital storage device), or on a remote server (e.g., an Internet server). With appropriate software stored on an Internet server or otherwise accessible over a network, such as the Internet, the game 100 may be played by remotely located players, provided that each player's computer includes an appropriate sound card or the like to enable the player to hear the music clip. In a purely electronic form of the game 100, the category attributes may be displayed on the computer screen or monitor and selected using a mouse, a touchpad, or any other user interface. The questions and answers may be stored in memory and displayed to the players automatically either before or after the song clip is played. Each player's score may be automatically maintained by the computer and electronic game tokens 112 may be distributed and retrieved by the game application in accordance with the game's operation. Lastly, "STEAL" cards 108 or other indicia may be electronically implemented, distributed to players in response to electronically spinning spinner 104 and having the electronic needle (e.g., random number generator) land on the "STEAL" card section 114, and played by the players (e.g., through selection of a "STEAL" card with the computer's user interface).

The present invention encompasses a method and apparatus for playing a quiz game. With this invention, selection of the category of questions to be answered in a quiz game is rendered more fair by selecting attributes of the category partially by the player's preference and partially by chance. By utilizing such a selection technique, the present invention provides a means for "leveling the playing field" of a quiz game for players of various ages. Since younger players are more familiar with current events and older players are more familiar with past events, a quiz game including both types of players is difficult to play fairly when question categories are selected purely by chance. Such quiz games can be made much fairer through use of the category selection methodology of the present invention. In addition, the category selection technique of the present invention may be beneficially employed by an audio quiz game in which players attempt to answer questions associated with an audio clip (e.g., music) corresponding to the selected category attributes. In contrast to prior art audio quiz games that require manual retrieval of the audio clip to be played or a player's having to input an index or address of an audio clip into the audio playing device, the present invention provides automatic retrieval of an audio clip without requiring the user or players to know the exact address or index of the clip, thereby enabling play of the game to flow smoother with less delays involving access of the audio clip. Further, the disclosed audio playing device, unlike any other comparable devices, allows an individual to input attributes of a song the individual desires to hear and listen to such a song without requiring the individual to know the name or artist of the song. Thus, the audio playing device of the present invention provides a means for music lovers to reminisce in popular songs of their respective eras without having to remember the names and artists of the songs.

In the foregoing specification, the present invention has been described with reference to specific embodiments. However, one of ordinary skill in the art will appreciate that various modifications and changes may be made without departing from the spirit and scope of the present invention as set forth in the appended claims. Accordingly, the specification and drawings are to be regarded in an illustrative rather than a restrictive sense, and all such modifications are intended to be included within the scope of the present invention.

Benefits, other advantages, and solutions to problems have been described above with regard to specific embodiments of the present invention. However, the benefits, advantages, solutions to problems, and any element(s) that may cause or result in such benefits, advantages, or solutions, or cause such benefits, advantages, or solutions to become more pronounced are not to be construed as a critical, required, or essential feature or element of any or all the claims. As used herein and in the appended claims, the term "comprises," "comprising," or any other variation thereof is intended to refer to a non-exclusive inclusion, such that a process, method, article of manufacture, or apparatus that comprises a list of elements does not include only those elements in the list, but may include other elements not expressly listed or inherent to such process, method, article of manufacture, or apparatus.

What is claimed is:

1. In a game in which a player attempts to answer at least one question in a category, a method for a player whose turn is currently in process to select the category for the at least one question, the method comprising the steps of:

selecting at least a first attribute-of the category based on an individual preference of the player; and selecting at least a second attribute of the category by chance, wherein the at least a first attribute and the at least a second attribute together define the category.

2. The method of claim 1, wherein the at least a first attribute of the category comprises a first time period.

3. The method of claim 2, wherein the at least a second attribute of the category comprises a second time period within the first time period.

4. The method of claim 2, wherein the first time period is a decade.

5. The method of claim 4, wherein the second time period is a year of the decade.

6. The method of claim 1, wherein the category relates to music and wherein the at least a first attribute of the category comprises at least one of a type of music and a genre of music.

7. The method of claim 1, wherein the at least a second attribute of the category comprises a recognition attribute.

8. A method for playing a game in which a player attempts to provide an answer to at least one question after listening to an audio clip related to the at least one question, the method comprising the steps of:

providing a source of questions and answers, the questions and answers being arranged into a plurality of categories, each category including at least one question and answer;

providing an audio source containing's electively accessible audio clips, each audio clip containing information relating to a corresponding category of questions and answers;

selecting, by a player whose turn-is currently in process, a category of the plurality of categories to produce a selected category by selecting at least a first attribute of the category based on an individual preference of the player and selecting at least a second attribute of the category by chance, wherein the at least a first attribute and the at least a second attribute together define the selected category; and playing the audio clip from the audio source, the audio clip relating to the selected category.

9. The method of claim 8, further comprising the step of:

playing the audio clip a second time prior to an attempt to answer the at least one question.

10. The method of claim 8, wherein the audio clip comprises music.

11. The method of claim 8, wherein each question in the selected category has a predetermined number of points associated therewith, and wherein the method further comprises the step of:

receiving the predetermined number of points for each question in the selected category that is answered correctly.

12. The method of claim 8, further comprising the step of:

receiving a token for correctly answering all of the questions in the selected category.

13. The method of claim 8, further comprising the steps of:

indicating, by another player, an intention to attempt to answer the at least one question in the selected category before the player whose turn is currently in process attempts to answer the at least one question; and attempting to answer, by the other player, the at least one question in the selected category.

14. The method of claim 13, wherein each question in the selected category has a predetermined number of points associated therewith and wherein the method further comprises the step of:

receiving, by the other player, the predetermined number of points for each question in the selected category that is answered correctly.

15. The method of claim 14, further comprising the step of:

attempting to answer any questions incorrectly answered by the other player in the event that the other player does not correctly answer all of the questions in the selected category.

16. The method of claim 14, further comprising the step of:

subtracting, by the other player, an aggregate number of points associated with all questions in the selected category in the event that the other player answers all of the questions in the selected category incorrectly.

17. The method of claim 14, further comprising the step of:

returning, by the other player, a token in the event that the other player answers all of the questions in the selected category incorrectly.

18. The method of claim 13, further comprising the step of:

receiving, by the other player, a token for correctly answering all of the questions in the selected category.

19. The method of claim 13, wherein the step of indicating occurs before the step of selecting a category.

20. The method of claim 13, wherein the step of indicating occurs before the step of selecting a category.

21. The method of claim 13, wherein the step of indicating comprises the step of:

presenting an indici to all players of the game, wherein the indicia indicates an the at least one question in the selected category.

22. The method of claim 21, further comprising the step of:

obtaining, by the other player, the indicia by chance during a turn initiated by the other player.

23. An apparatus for playing a game in which a player attempts to answer at least one question in a category, the apparatus comprising:

a source of questions and answers, the questions and answers being arranged into a plurality of categories, each category including at least one question and answer; and at least one selector for selecting, by chance, at least a first attribute of a plurality of attributes defining a selected category of questions and answers, the plurality of attributes including at least a second attribute selected based on an individual preference of the player.

24. The apparatus of claim 23, wherein the source of questions and answers comprises a source of questions and a source of answers, and wherein the source of questions comprises a plurality of areas of the at least one selector.

25. The apparatus of claim 23, further comprising:

an indicia for indicating an intention of another player to attempt to answer the questions in the selected category before the player whose turn is currently in process attempts to answer the questions.

26. The apparatus of claim 25, wherein the indicia is a labeled card.

27. The apparatus of claim 23, wherein the at least one selector comprises two spinners for selecting the at least a first attribute.

28. The apparatus of claim 27, wherein a first spinner of the two spinners is used to select a recognition attribute and wherein a second spinner of the two spinners is used to select a time attribute, the time attribute comprising a first time period within a second time period selected based on the individual preference of the player.

29. The apparatus of claim 27, wherein a first spinner of the two spinners resembles a 33 ⅓-RPM speed record album and wherein a second spinner of the two spinners resembles a 45-RPM speed record album.

30. The apparatus of claim 23, further comprising:

an audio playing device for playing an audio clip, the audio clip being selectively accessible and relating to the selected category of questions and answers, wherein the player attempts to answer at least one question in the selected category after listening to the audio clip.

31. The apparatus of claim 30, wherein the audio playing device includes a display for presenting an identifier associated with a location in the source of questions and answers that contains the questions and answers for the selected category.

32. The apparatus of claim 30, wherein the audio playing device comprises:

a user input device for inputting the plurality of attributes and an indication of a desire by the player to listen to the audio clip;

at least one digital storage device for storing a plurality of audio clips, the plurality of audio clips including the audio clip;

at least one processor operably coupled to the user input device and the at least one digital storage device, the at least one processor receiving the plurality of attributes and the indication from the user input device, determining the selected category of questions and answers based on the plurality of attributes, and retrieving the audio clip from the at least one digital storage device based on the selected category of questions and answers;

an audio display device, operably coupled to the at least one processor, for audibly playing the audio clip; and memory, operably coupled to the at least one processor, for storing at least one database relating the selected category of questions and answers to the audio clip, the at least one database being searchable by the at least one processor.

33. The apparatus of claim 32, wherein the user input device includes a data input portion and an audio control portion, the data input portion facilitating input of the plurality of attributes and the audio control portion enabling the player to indicate a desire to listen to the audio clip.

34. The apparatus of claim 32, further comprising:

an alpha-numeric display, operably coupled to the at least one processor, for displaying an identifier associated with a location in the source of questions and answers that contains the questions and answers for the selected category.

35. The apparatus of claim 32, wherein the audio display device comprises at least one speaker.

36. The apparatus of claim 32, wherein the user input device further enables the player to indicate a desire to replay the audio clip at least once.

37. The apparatus of claim 32, wherein the at least one digital storage device comprises at least one of a flash memory card, a CD-ROM, a digital versatile disk (DVD), a floppy disk, and a magnetic tape.

38. The apparatus of claim 23, wherein the source of questions and answers and the at least one selector are implemented in at least one of software and firmware.

39. An audio playing device, comprising:

a user input device for inputting a plurality of attributes relating to an audio category and for inputting an indication of a desire by a user to listen to an audio clip from the audio category;

at least one digital storage device for storing a plurality of audio clips, the plurality of audio clips including the audio clip;

at least one processor operably coupled to the user input device and the at least one digital storage device, the at least one processor receiving the plurality of attributes and the indication from the user input device, and retrieving the audio clip from the at least one digital storage device based on the plurality of attributes;

an audio display device, operably coupled to the at least one processor, for audibly playing the audio clip; and memory, operably coupled to the at least one processor, for storing at least one database relating the plurality of attributes to the audio clip, the at least one database being searchable by the at least one processor.

40. The audio playing device of claim 39, wherein the user input device includes a data input portion and an audio control portion, the data input portion facilitating input of the plurality of attributes and the audio control portion enabling the user to indicate a desire to listen to the audio clip.

41. The audio playing device of claim 39, wherein the audio display device comprises at least one audio amplifier and at least one speaker.

42. The audio playing device of claim 39, wherein the user input device further enables the user to indicate a desire to replay the audio clip at least once.

43. The audio playing device of claim 39, wherein the at least one digital storage device comprises at least one of a flash memory card, a CD-ROM, a digital versatile disk (DVD), a floppy disk, and a magnetic tape.

44. The audio playing device of claim 39, wherein the audio playing device is used to play a game in which a player attempts to answer at least one question related to the audio clip after listening to the audio clip, the audio playing device further comprising:

an alpha-numeric display, operably coupled to the at least one processor, for displaying an identifier associated with a location in a source of questions and answers that contains an answer to the at least one question.

45. The audio playing device of claim 39, wherein the plurality of attributes includes at least a first attribute selected by the user by chance and at least a second attribute selected based on an individual preference of the user.

46. A storage medium for use with an audio playing device that includes a user input device, at least one digital storage device, at least one processor, and an audio display device, the storage medium comprising:

memory including operating instructions that, when executed, cause the at least one processor to:

receive, from the user input device, a plurality of attributes relating to an audio category and an indication of a desire by a user to listen to an audio clip from the audio category;

retrieve the audio clip from the at least one digital storage device based on the plurality of attributes; and provide the audio clip to the audio display device for presentment of the audio clip to the user.

47. The storage medium of claim 46, wherein the plurality of attributes includes at least a first attribute selected by the user by chance and at least a second attribute selected based on an individual preference of the user.

48. In a game in which a player attempts to answer at least one question in a category, a method for selecting the category for the at least one question, the method comprising the steps of:

selecting, during play of the game, at least a first attribute of the category based on an individual preference of the player; and selecting, during play of the game, at least a second attribute of the category by chance, wherein the at least a first attribute and the at least a second attribute together define the category.

49. A method for playing a game in which a player attempts to provide an answer to at least one question, the game including a source of questions and answers, the questions and answers being arranged into a plurality of categories, each category including at least one question and answer, the method comprising the steps of:

selecting, during play of the game, a category of the plurality of categories to produce a selected category by selecting at least a first attribute of the category based on an individual preference of the player and selecting at least a second attribute of the category by chance, wherein the at least a first attribute and the at least a second attribute together define the selected category; and attempting to answer a question in the selected category.

* * * * *